United States Patent [19]

Gagnon et al.

[11] Patent Number: 4,480,296

[45] Date of Patent: Oct. 30, 1984

[54] TWO-FILAMENT LAMP FOR AUTOMOBILE HEADLIGHT

[75] Inventors: Peter R. Gagnon, Georgetown; John J. Lumia; Stephen J. Leadvaro, both of Salem; James C. Morris, Wakefield, all of Mass.

[73] Assignee: GTE Products Corporation, Stamford, Conn.

[21] Appl. No.: 335,135

[22] Filed: Dec. 28, 1981

[51] Int. Cl.[3] ..... F21M 3/30

[52] U.S. Cl. ..... 362/211; 362/267; 362/375; 362/307; 362/80; 362/310; 362/311; 313/115; 313/579

[58] Field of Search ..... 362/211, 217, 267, 369, 362/306, 390, 215, 80, 307, 310, 311, 375; 313/569, 578, 579, 113

[56] References Cited

U.S. PATENT DOCUMENTS

| | | | |
|---|---|---|---|
| 2,214,472 | 9/1940 | Lund | 362/211 |
| 3,549,935 | 12/1970 | Motoyama et al. | 362/212 X |
| 3,898,451 | 8/1975 | Murphy et al. | 362/211 |
| 4,233,536 | 11/1980 | Waymouth et al. | 313/569 X |
| 4,240,131 | 12/1980 | Albrecht | 362/267 |
| 4,297,611 | 10/1981 | Cortorillo | 313/579 |
| 4,319,156 | 3/1982 | Bienvenue et al. | 362/211 X |

FOREIGN PATENT DOCUMENTS

| | | | |
|---|---|---|---|
| 1430736 | 1/1966 | France | 362/211 |
| 2062958 | 5/1981 | United Kingdom . | |

*Primary Examiner*—Peter A. Nelson

*Attorney, Agent, or Firm*—Edward J. Coleman

[57] ABSTRACT

A tungsten-halogen lamp for use in an automobile headlight comprises a tubular sealed glass capsule containing two coiled tungsten filaments for high and low beam operation, respectively. The low beam filament is disposed substantially orthogonal to a vertical plane containing the lamp axis, with the center of that filament length having a predetermined offset from that vertical plane and being disposed at or near the focal point of the reflector. The high beam filament is disposed substantially parallel to the lamp axis on the opposite side of the vertical plane from at least a major portion of the low beam filament. The filaments are spaced apart with the high beam filament lying in a horizontal plane spaced below the low beam filament, and the axis of the high beam filament orthogonally intersects a plane containing in the axis of the low beam filament.

11 Claims, 5 Drawing Figures

TWO-FILAMENT LAMP FOR AUTOMOBILE HEADLIGHT

BACKGROUND OF THE INVENTION

This invention relates to automobile headlight units containing incandescent lamp capsules, and more particularly, to incandescent lamps for such headlight units containing two filaments for high and low beam operation.

Heretofore, in the typical automobile headlight lamps manufactured in the United States for providing low and high beam operation, the lens has been designed principally for low beam operation, with the high beam, at best, a compromise. A typical low beam pattern generally has low intensity, wide spread, and very little light in the upper left hand area, as projected on a screen in front of the headlight. An ideal high beam pattern is of very high intensity with very little spread. The high beam is normally aimed straight ahead, along a line perpendicular to the lens face and through its center, as opposed to the low beam, which is usually directed somewhat downward and to the right when viewed from behind the headlight. Since both beams must come from the same combination of reflector and lens, ideal high and low beams cannot be readily achieved in the same lamp. Typically, U.S. headlight manufacturers have used a filament arrangement wherein the filaments are parallel to the road surface and orthogonal to the axis of the reflector; for example, see U.S. Pat. No. 3,898,451.

European headlight manufacturers, however, often use a filament arrangement wherein both filaments are mounted parallel to the reflector axis, and are axially displaced from each other. The high beam filament is usually at the focal point, with the low beam filament displaced axially forward of the high beam filament, i.e., away from the reflector. The low beam filament is usually also partially surrounded by a shield to reduce glare. For example, a typical European headlight lamp capsule, referred to as the "H4" type, is described in U.S. Pat. Nos. 3,646,385 and 3,646,386. This design tends to be somewhat inefficient on low beam due to the effects of the shield, and also due to the fact that the low beam filament is so far off focus.

Yet another filament arrangement is described in U.S. Pat. Nos. 3,493,806 and 3,569,693, wherein the low beam filament is axially disposed on the optical axis of the headlight, and the high beam filament is located behind the low beam filament (closer to the vertex of the reflector) and centrally disposed on but orthogonal to the optical axis. In U.S. Pat. No. 3,493,806, the filaments are disposed in a separate sealed lamp envelope with a screen means provided on the exterior surface of the envelope. U.S. Pat. No. 3,569,693 does not employ a sealed lamp capsule within the headlight but uses a shield between the low and high beam filaments.

U.S. Pat. No. 2,791,714 describes a dual filament arrangement in an airplane headlight for selectively projecting either a landing beam or a taxiing beam. This headlight employs a main high wattage filament which is axially disposed on focus along the optical axis of the headlight reflector. The headlight also includes a supplementary lower wattage filament in the form of a linear coil extending transversely of the reflector axis and disposed approximately in the focal plane of the reflecting surface. Further, the supplementary filament is disposed approximately symmetrical with respect to the vertical axial plane of the reflector and approximately parallel to the horizontal axial plane of the reflector. The supplementary filament is operated in parallel with and positioned horizontally and above the main filament to provide the landing beam. In operation, the lamp is connected in an operating circuit which is adapted to selectively connect either the supplementary filament alone or the two filaments in parallel across an electric power supply. When the line voltage is impressed across the horizontally disposed upper or supplementary filament alone, a relatively wide flood or taxiing beam of the required lateral spread is produced. When the line voltage is impressed across the main filament and the supplementary filament in parallel, a landing beam is produced having a generally circular shaped central hotspot portion with a slightly depressed wide spread portion of lower candle power to provide forground illumination.

In recent years, for styling and other considerations, rectangular headlights have come into vogue. Prior to this, domestic headlamps used reflectors of essentially parabolic cross-section, circular in shape, thus forming a paraboloid. Rectangular reflectors are also essentially paraboloidal but have a portion of the top and bottom of the reflector truncated, as shown in FIGS. 2 and 3. Both the round and rectangular domestic headlamps have typically used the parallel filament arrangement discussed hereinbefore with reference to U.S. Pat. No. 3,898,451.

Examination of the intensity distribution of a typical single-coil filament reveals that the radiation is maximum in a direction perpendicular to the axis. If this filament is placed in a round reflector with its length aligned perpendicularly to the axis of the reflector, maximum flux is emitted in those areas of the reflector which lie perpendicular to the length of the filament. Looking into the reflector from the front, one would see virtual images of the filament in various areas of the reflector, corresponding to the orientation of the filament. The projected image of the filament on a suitable distant screen produces the well known "bow-tie" pattern, the "knot" of which represents radiation from the central on-focus portion of the filament, and the "wings" representing the radiation from the off-focus ends of the filament. Placing this filament in a rectangular reflector in the usual horizontal orientation is essentially the same as truncating the round reflector in the previous example to a rectangular shape. Thus, the slight radiation from the "cold" ends of the filament is directed at those areas of the reflector with the highest flux collection efficiency. This situation could be rectified somewhat by rotating the filament 90° into a vertical orientation, but the spread light, which would be spread vertically, would significantly increase the beam intensity well above the horizon. This can be very objectionable because it has the potential of producing back scattered light under certain driving conditions, such as rain, fog or snow.

However, aligning the filament coaxially with the reflector axis distributes the filament flux symmetrically about the reflector, with the respective images of the filament radially disposed in the upper portion of the reflector. With this distribution, those areas of the reflector which are not truncated are put to better use. The projection of these images on a screen would be as a target centered below and to the right of the center of the screen coaxial with the optic axis of the headlight.

This circular pattern has its highest intensity at the center and decreasing intensity radially outward from the center.

Since the high beam is used to see far ahead, only the light coming out of the headlight in a small cone is of much use. With this in mind, an experiment was performed to compare the quantity of light delivered into a cone with a total included angle of about 14° by similar filaments with axial and horizontal orientations in a typical rectangular reflector. The result was that in the 14° cone, the axially oriented filament delivered approximately 10% more light. Thus, a 10% efficiency gain is realized. Also due to the geometry of the axial filament orientation, the ends of the filament, which are off-focus, have their magnified projected images superimposed rather than diametrically opposed as in the case of the transverse filament. This effectively decreases the main beam spread, thereby increasing the maximum beam intensity attainable from a similar filament mounted in the usual transverse fashion. Thus, with the use of the axially mounted high beam filament, as described hereinafter in accordance with the present invention, both the maximum intensity and efficiency increase. These changes are very desireable since the energy of the high beam can better be concentrated down the road, improving the seeing distance while utilizing no additional energy.

SUMMARY OF THE INVENTION

It is an object of the present invention to provide an improved automobile headlight unit having increased high beam efficiency and intensity, particularly in the case of rectangular headlights.

A further object is to provide an improved incandescent lamp for use in automobile headlights.

These and other objects, advantages and features, are attained, in accordance with the invention, by an incandecent lamp comprising an hermetically sealed light-transmitting envelope having a base portion at one end and first and second filament disposed within the envelope. The first filament is substantially orthogonal to a first plane containing the axis of the lamp, with the center of the first filament length having a predetermined offset from that first plane. The second filament is substantially parallel to the lamp axis on the opposite side of the first mentioned plane from at least a major portion of the first filament. The first and second filaments are spaced apart and disposed on opposite sides of a second plane containing the axis of the lamp and lying orthogonal to the first mentioned plane, and the axis of the second filament orthogonally intersects a plane containing the axis of the first filament.

According to another aspect, the invention is defined in an automobile headlight unit, which when oriented to have a substantially horizontal optical axis, includes a lamp capsule which cooperates with a substantially parabolic reflector and is disposed substantially parallel with the optical axis. A low beam filament is disposed within the lamp capsule substantially orthogonal to a vertical plane containing the axis of the lamp, with the center of the low beam filament length having a predetermined offset from the vertical plane. Further, the low beam filament is located at or near the focal point of the reflector. A high beam filament is also disposed within the lamp capsule substantially parallel to the optical axis on the opposite side of the vertical plane from at least the major portion of the low beam filament. Both of the filaments are spaced apart with the high-beam filament lying in a horizontal plane spaced below the low beam filament, and the axis of the high beam filament orthogonally intersects a plane containing the axis of the low beam filament. In a particularly useful embodiment of the invention, the lamp capsule contains a halogen and the high and low beam filaments are tungsten, whereby the capsule operates as a tungsten-halogen incandescent lamp.

BRIEF DESCRIPTION OF THE DRAWINGS

This invention will be more fully described hereinafter in conjunction with the accompanying drawings, in which.

DESCRIPTION OF PREFERRED EMBODIMENT

Figure 1:
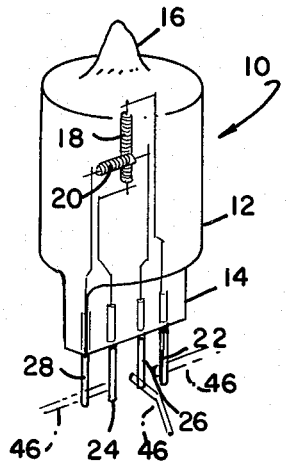
FIG. 1 is a perspective view of an incandescent lamp, also referred to as a lamp capsule, in accordance with the invention.

Referring to FIG. 1, an incandescent lamp 10, also referred to as a lamp capsule, includes a hermetically sealed, light-transmitting envelope 12 having a press-seal base portion 14 at one end and an exhaust tip-off 16 at the opposite end. Disposed within lamp envelope 12 are two spaced apart filaments 18 and 20. Both filaments are illustrated as being of a coil type, with filament 18 being supported longitudinally within the lamp envelope 12 by means of a pair of lead-in wires 22 and 24 sealed through the base portion 14, and with the filament 20 being supported transversely within the envelope by a pair of lead-in wires 26 and 28 also sealed through base 14. According to a typical particularly useful embodiment, the lamp is of the tungsten-halogen type, with envelope 12 being formed of quartz or preferably a hardglass, filaments 18 and 20 being of tungsten, and the lamp capsule containing a gaseous filling including a halogen.

Figure 2:
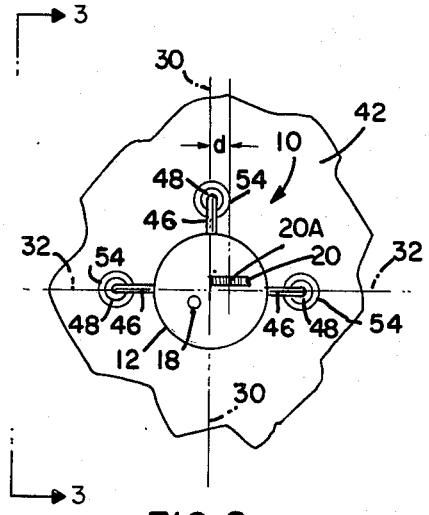
FIG. 2 is a front elevational view of the lamp of FIG. 1 mounted on a reflector, shown in fragmentary form.
Figure 3:
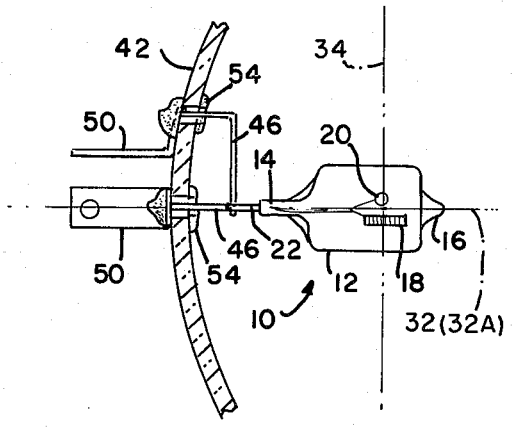
FIG. 3 is a view taken along 3—3 of FIG. 2.

The specific orientation of the filaments 18 and 20 is best shown in FIGS. 2 and 3. The filament 20 is disposed in the envelope 12 substantially orthogonal to a first plane 30 containing the axis of the lamp, plane 30 orthogonally intersecting the surface of the drawing FIG. 2 where denoted by the phantom line 30. More specifically, best as illustrated in FIG. 2, it is the axis of coil 20 which is orthogonal to plane 30, with the center 20*a* of the filament 20 length having a predetermined offset d from the plane 30. In a preferred embodiment, this offset d is in the range of 1.5 to 3.0 millimeters. The axis of the filament coil 18, on the other hand, is disposed substantially parallel to the axis of the lamp on the opposite side of plane 30 from at least the major portion of the filament 20. Further, filament 20 and 18 are spaced apart and disposed on opposite sides of a plane 32 containing the axis of the lamp and lying orthogonal to the plane 30, plane 32 orthogonally intersecting the surface of the drawing FIGS. 2 and 3 were denoted by the phantom line 32. Further yet, as best illustrated in FIG. 3, the axis of the filament 18 orthogonally intersects a plane 34 containing the axis of filament 20, the plane 34 orthogonally intersecting the surface of the drawing FIG. 3 as denoted by the phantom line 34. Preferably, plane 34 intersects the filament 18 substantially at the midpoint thereof. Depending upon the application, the filament orientation may be reversed in that filament 20 may be positioned on the left hand side of plane 30 (in FIG. 2), and axial filament 18 may be located on the right hand side of plane 30.

The foregoing description has been set forth with respect to the construction of the lamp 10 itself; although the lamp is shown in FIGS. 2 and 3 as mounted on a reflector, the components of which are now to be described in detail hereinafter.

Figure 4:
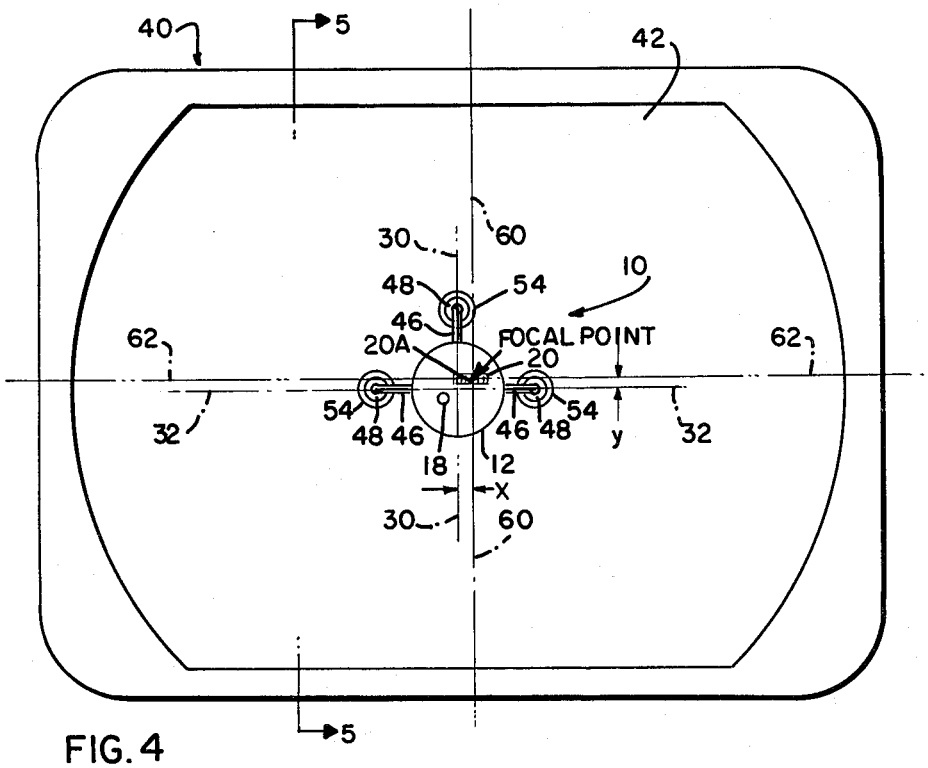
FIG. 4 is a front elevational view of a rectangular automobile headlight unit in accordance with the invention, with the lens removed for more clearly illustrating the lamp capsule (of the type shown in FIG. 1) and the reflector.
Figure 5:
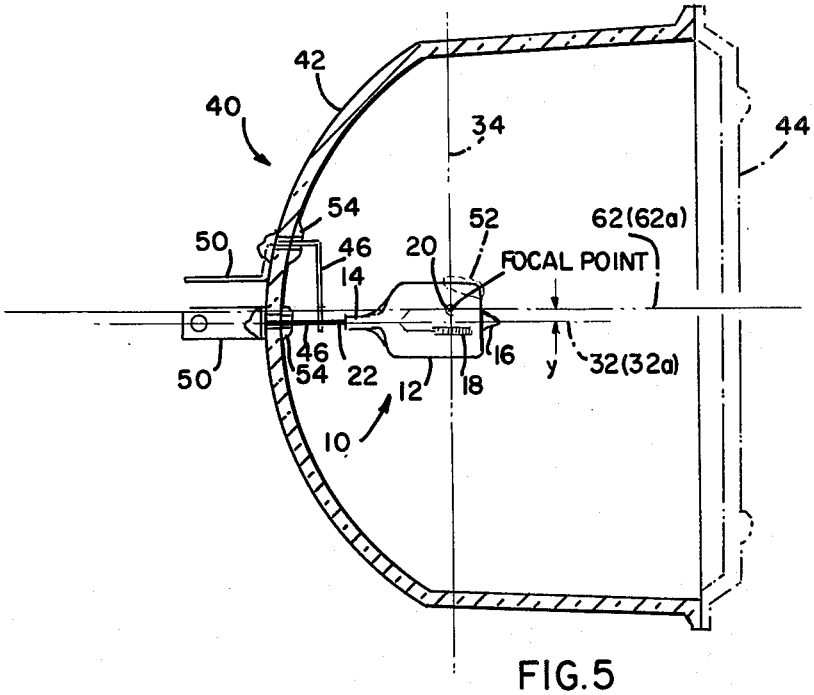
FIG. 5 is a view taken along line 5—5 of FIG. 4, with the lens shown in phantom.

As described hereinbefore, the lamp capsule of FIG. 1 is particularly useful when employed in an automobile headlight unit of the type illustrated in FIGS. 4 and 5. The rectangular headlight unit 40 comprises a glass or plastic or metal reflector 42, which is substantially parabolic as illustrated, and the lamp capsule 10, which functionally cooperates with the reflector and is disposed with the lamp axis 32*a* (FIG. 5)(intersection of lines 30 and 32 in FIG. 4) substantially parallel with the optical axis 62*a* (denoted by a phantom line in FIG. 5 and by the denoted focal point of the reflector in FIG. 4). Phantom lines 60 and 62 (FIG. 4) represent vertical and horizontal axes, respectively, of the reflector 42 and corresponding planes intersecting the surface of FIG. 4 thereat.

Further, the lamp capsule is oriented with the press-seal base portion 14 facing the vertex of the reflector. As illustrated in the drawings the headlight unit is typically oriented to have a substantially horizontal optical axis 62*a*. Although not shown in FIG. 4, the completed headlight unit includes a glass or plastic lens 44 bonded to the front of the reflector 42, the lens being illustrated by dashed lines in FIG. 5.

The lamp capsule 10 is of the type shown and described with respect to FIG. 1 and, thus, the components thereof, along with the described orthogonal planes containing the lamp axis, are labeled with the same identifying numerals as employed for corresponding components, and planes, in the lamp of FIG. 1. Lamp capsule 10 is supported in the position illustrated by means of a plurality of heavy conductor wires 46 which are welded to selected respective lead-in wires 22, etc. of the lamp 10 and extend through holes 48 in the reflector 42. Each conductor 46 is then electrically connected, such as by soldering, to a respective contact lug 50 on the back of the reflector 42.

A preferred connection and seal means through the back of the reflector for the support conductors 46 is described in U.S. Pat. No. 4,181,869, wherein an eyelet 54 is employed in the hole 48 to hold the lug 50 securely in place and to provide a rigid point to which the support conductor 46 may be attached.

In the illustrated headlight unit application, the filament 18 of the lamp capsule operates as the high beam filament, while filament 20 functions as the low beam filament. With the headlight unit positioned so that the optical axis is horizontal and with the lamp capsule 10 positioned with respect to reflector 42 such that the press seal base lies essentially in a plane normal to the surface of the drawing at line 32, and the lamp being disposed such that the center 20*a* of the low beam filament is at or near the focal point of the reflector 42, the unique respective filament configurations described hereinbefore with respect to the lamp of FIG. 1 result in the following high beam-low beam filament orientation with respect to the headlight reflector, in accordance with the invention. More specifically, low beam filament 20 is disposed within the capsule with its axis substantially orthogonal to the vertical lamp and reflector planes 30 and 60 (normal to the drawing FIG. 4). Plane 60 contains the optical axis 62*a* and the center 20*a* of filament 20, which has a predetermined horizontal offset x (equals d of FIG. 2) from the vertical plane 30, as best illustrated in FIG. 4. As previously mentioned, this horizontal offset d (or x) is in the range of 1.5 to 3.0 millimeters. The axis of filament 20 also has a vertical offset y from the horizontal plane 32; this vertical offset may be in the range of 0.5 to 1.5 millimeters. In this manner, the low beam filament is at or near the denoted focal point of the reflector, and the axis of the capsule is displaced from the axis of the headlight by the aforementioned predetermined amount of x and y.

The high beam filament 18 is disposed within the capsule 10 with its axis substantially parallel to the optical axis 62*a* on the opposite side of the vertical plane 30 from at least the major portion of the low beam filament 20. The filaments 18 and 20 are spaced apart with the high beam filament 18 lying in a horizontal plane spaced below the low beam filament 20, and the axis of the high beam filament 18 orthogonally intersects a plane 34 (normal to drawing in FIG. 5) containing the axis of the low beam filament 20. Preferably, the plane 34 containing the axis of the low beam filament 20 intersects the high beam filament 18 substantially at the midpoint thereof, as shown in FIG. 5.

As illustrated by the dashed lines 52 in FIG. 5, the top dome portion of the capsule 10 may have an opaque coating of the type described, for example, in U.S. Pat. No. 4,288,713. Such coatings are typically used in automobile headlights to serve as a screen for blocking some of the visible light radiated by the lamp filament.

Typically, the reflector 42 is an offset parabola, such that the light from a point source located at the focal point of the reflector would emerge at an angle of approximately 3° down and 3° right as viewed from behind the reflector. This type of reflector is commonly used in domestic, two filament, rectangular headlights. The optical power of the lens 44 is used to aim and shape the beam according to industry and/or government standards.

The filament orientation of FIGS. 4 and 5 is applicable for headlights used on automobiles intended for driving on the right hand side of the road; this filament orientation is reversed, of course, for automobiles intended for driving on the left hand side of the road.

For purposes of comparison, several rectangular headlights of the "2B" type were constructed with similar lenses and reflectors, some with axial, and some with transversely oriented high beam filaments. These filaments were all of essentially equal output, and all were located similarly with respect to the focal point of the reflectors. From the isocandela patterns generated, it was observed that the axially placed high beam filament produced a more intense beam, with narrower spread, than the transversely located filament. Readings taken on a number of lamps indicated that an increase of up to 35% in maximum candle power was possible with the axial orientation.

Low beam tests of headlights having lamp capsules with filament orientations as described hereinbefore with respect to FIGS. 2 and 3 also exhibited a higher output within the area desired. This improved low beam performance appears to result from a reduction of shadowing in the low beam mode due to the rotated positioning (axial) of the high beam filament. In general, therefore, on a point by point comparison, headlights having lamp capsules constructed in accordance with the invention showed a marked tendency for higher output in desired areas.

Other benefits can also be derived from the axial orientation of the high beam filament. In the case of halogen lamps, since the total width or lateral dimension of the filament pair is reduced for an equivalent lateral beam shift, the use of a smaller diameter halogen bulb may become possible due to reduced thermal loading of the bulb walls, and the increased clearance for assembly. The use of a smaller bulb has the advantage of reduced mass, such that the bulb support structure can be less massive for equivalent resistance to mechanical shock and vibration. The size reduction also reduces the cost of the bulb and supporting structure. Also since the bulbs of halogen lamps contribute significantly to low beam glare, because they act as low intensity, out of focus, sources, the reduction in bulb size can reduce glare because the bulb walls are nearer the focal points of the lamp.

Although the invention has been described with respect to specific embodiments, it will be appreciated that modifications and changes may be made by those skilled in the art without departing from the true spirit and scope of the invention.

We claim:

1. An incandescent lamp comprising: an hermetically sealed light-transmitting envelope having a base portion at one end; a first filament having a linear axis disposed in said envelope substantially orthogonal to a first plane containing the axis of said lamp, with the center of said first filament length having a predetermined finite offset from said first plane; and a second filament having a linear axis disposed in said envelope substantially parallel to the axis of said lamp on the opposite side of said first plane from at least the major portion of said first filament, said first and second filaments being spaced apart and disposed on opposite sides of a second plane containing the axis of said lamp and lying orthogonal to said first plane, and the axis of said second filament orthogonally intersecting a plane containing the axis of said first filament.

2. The lamp of claim 1 wherein said lamp is a tungsten-halogen type for use in an automobile headlight unit, said first and second filaments are respective tungsten coils supported on lead-in wires sealed through the base portion of said envelope, the axis of said first filament coil is substantially orthogonal to said first plane, and the axis of said second filament coil is substantially parallel to said lamp axis.

3. The lamp of claim 2 wherein said plane containing the axis of said first filament intersects said second filament substantially at the midpoint thereof.

4. The lamp of claim 1 wherein said predetermined offset is in the range of 1.5 to 3.0 millimeters.

5. In an automobile headlight unit, which when oriented to have a substantially horizontal optical axis, includes a lamp capsule which cooperates with a substantially parabolic reflector and is disposed substantially parallel with said optical axis, the improvement in combination therewith comprising: a low beam filament having a linear axis disposed within said capsule substantially orthogonal to a vertical plane containing the axis of said lamp, with the center of said low beam filament length having a predetermined finite offset from said vertical plane and being disposed at or near the focal point of said reflector; and a high beam filament having a linear axis disposed within said capsule substantially parallel to said optical axis on the opposite side of said vertical plane from at least the major portion of said low beam filament lying in a horizontal plane spaced below said low beam filament, and the axis of said high beam filament orthogonally intersecting a plane containing the axis of said low beam filament.

6. The headlight unit of claim 5 wherein said lamp capsule contains a halogen and said high and low beam filaments are tungsten, wereby said capsule operates as a tungsten-halogen incandescent lamp.

7. The headlight unit of claim 5 wherein said lamp capsule has a tubular envelope with an exhaust tip at one end and a base portion at the opposite end from said exhaust tip, and said high and low beam filaments are respective coils supported on lead-in wires sealed through the base portion of said envelope.

8. The headlight unit of claim 7 wherein the axis of said low beam filament coil is substantially orthogonal to said vertical plane, and the axis of said high beam filament is substantially parallel to said optical axis.

9. The headlight unit of claim 8 wherein said plane containing the axis of said low beam filament intersects said high beam filament substantially at the midpoint thereof.

10. The headlight unit of claim 7 wherein said base portion is a press-seal and faces the vertex of said reflector.

11. The headlight unit of claim 5 wherein said predetermined offset is in the range of 1.5 to 3.0 millimeters.

* * * * *